US005240452A

United States Patent [19]

Wen

[11] Patent Number: 5,240,452

[45] Date of Patent: Aug. 31, 1993

[54] APPARATUS FOR TOSSING CONFETTI AND EXPRESSING A CELEBRATORY GREETING

[76] Inventor: Elizabeth Wen, 86-47 Clio St., Holliswood, N.Y. 11423

[21] Appl. No.: 685,133

[22] Filed: Apr. 15, 1991

[51] Int. Cl.[5] ..... A63H 33/30; A63H 33/00; B65D 73/00

[52] U.S. Cl. ..... 446/475; 446/5; 446/488; 206/470

[58] Field of Search ..... 446/475, 483, 486, 487, 446/488, 490, 491, 4, 5, 387, 388; 40/124.1; 206/470, 469

[56] References Cited

U.S. PATENT DOCUMENTS

| | | | |
|---|---|---|---|
| 825,843 | 7/1906 | Kliemandt | 446/475 X |
| 1,650,762 | 11/1927 | Machin | 446/5 |
| 1,727,706 | 9/1929 | Hitt | 446/5 |
| 1,809,635 | 6/1931 | Luhrs | 446/388 |
| 3,597,296 | 8/1971 | Lewis | 446/487 X |
| 4,667,961 | 5/1987 | Abu-Shumays et al. | 446/487 X |
| 4,787,160 | 11/1988 | Balsamo | 206/470 X |
| 4,832,337 | 5/1989 | Estrada | 446/5 X |

FOREIGN PATENT DOCUMENTS

| | | | |
|---|---|---|---|
| 122041 | 3/1931 | Austria | 446/475 |
| 16062 | of 1905 | United Kingdom | 446/387 |
| 642987 | 9/1956 | United Kingdom | 446/488 |

*Primary Examiner*—Mickey Yu
*Assistant Examiner*—D. Neal Muir
*Attorney, Agent, or Firm*—Abdallah & Muckelroy

[57] ABSTRACT

A confetti tossing apparatus. Lengths of folded paper are fixedly attached between end panels and a body of confetti is disposed within the lengths of folded paper. The apparatus opens to a first position to display a first part of a celebratory greeting, for example the word "HAPPY". The apparatus is jerked while holding the end panels causing the apparatus to open to a second position. A second part of the celebratory greeting for example the word "BIRTHDAY" is displayed in conjunction with the first part of greeting, and the opening of the apparatus to its second position causes confetti to be tossed outwardly from the apparatus.

12 Claims, 10 Drawing Sheets

APPARATUS FOR TOSSING CONFETTI AND EXPRESSING A CELEBRATORY GREETING

BACKGROUND OF THE INVENTION

The present invention generally relates to party favors. More specifically, this invention relates to novel means for tossing confetti and expressing a celebratory gesture.

U.S. Pat. No. 4,787,160 to Balsamo discloses a greeting card having means to release confetti when the card is opened. To the Applicant's knowledge no other confetti tossing devices are shown in the prior art.

Confetti is widely used in celebrations. It is generally tossed by hand. A particular problem in the hand tossing of confetti is the storage of small quantities prior to use. Packets of confetti are generally used which are opened when ready to toss or opened and put into a pocket until ready to toss. A further problem with the confetti of the prior art is post-celebration clean up. The confetti in the prior art generally comprises two-dimensional shapes of paper which is difficult to remove from a floor or the like when dispersed. The novel confetti tossing device of the present invention overcomes these limitations of the prior art.

SUMMARY OF THE INVENTION

The present invention is a confetti tossing apparatus comprising a pair of end panels having respective handles extending therefrom and first, second and third lengths of laterally-curved paper folded in accordion fashion along their respective lengths and fixedly attached at ends thereof to the respective end panels. The lengths of laterally-curved paper are attached to the end panels in a manner such that when the respective end panels are rotated 180° within the plane of the length of the curved paper a first ornamental configuration of the curved paper is formed and when the apparatus is jerked longitudinally while holding the handles with the end panels so rotated a second ornamental configuration of the curved paper is formed having at least a portion of the curved paper disposed as in the first ornamental configuration. A quantity of confetti is disposed within the first ornamental configuration and released therefrom when the apparatus is jerked to form the second ornamental configuration. The consistent outward disposition of at least a portion of the curved paper in both the first configuration and the second configuration permits a first part of a celebratory gesture to be shown when the apparatus is disposed in the first ornamental configuration and a second part of a celebratory gesture to be shown in conjunction with the first part of the celebratory gesture when the apparatus is disposed in a second ornamental configuration.

An object of the present invention is to provide a novel party favor.

Another object of this invention is to provide an apparatus for tossing confetti.

A further object of this invention is to provide novel means to express a celebratory gesture.

It is also an object of this invention to provide a confetti tossing apparatus having an improved confetti construction.

These and other objects and advantages of the present invention will be apparent to those skilled in the art from the following description of preferred embodiments, drawing figures and appended claims.

DESCRIPTION OF PREFERRED EMBODIMENTS

Figure 1:
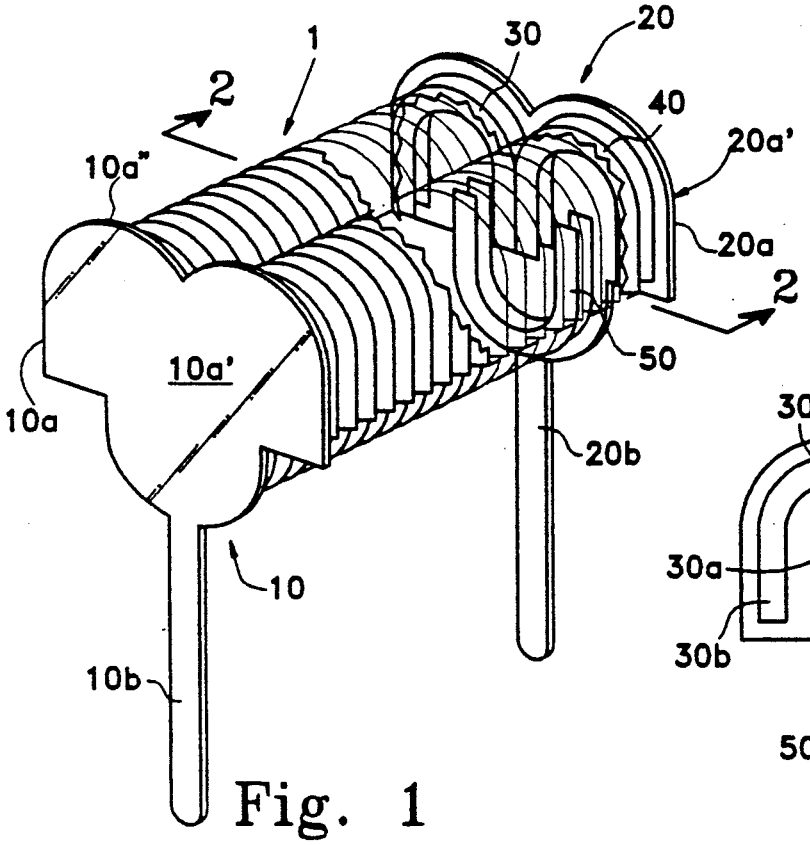
FIG. 1 is a partially fragmented perspective view of a first preferred embodiment of the confetti tossing apparatus of the present invention.

FIG. 1 illustrates a partially fragmented perspective view of a first preferred embodiment of the confetti tossing apparatus 1 of the present invention. Confetti tossing apparatus 1 generally comprises a first end panel 10, a second end panel 20, and first, second and third lengths of laterally-curved paper material 30, 40 and 50 fixedly attached at respective ends thereof to the respective first and second end panels 10 and 20. The respective end panels 10, 20 are formed having a billboard portion 10*a*, 20*a* and a handle portion 10*b*, 20*b* extending downwardly from the billboard portion 10*a*, 201. The first, second and third lengths of laterally-curved paper material 30, 40 and 50 are attached to the rearward faces 10a'', 20a'' of billboard portions 10a, 20a of the end panels 10, 20. The forward faces 10a', 20a' of the respective billboard portions 10a, 20a are initially outwardly disposed at respective ends of the apparatus 1.

Figure 2:
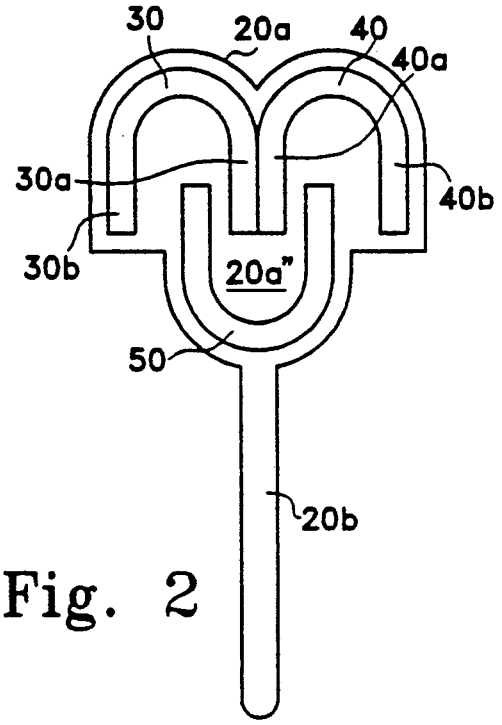
FIG. 2 is a plan cross-sectional view of the apparatus taken along line 2—2 of FIG. 1.

The first, second and third lengths of laterally-curved paper material 30, 40 and 50 are folded accordion-style along their respective lengths. As can be best seen in FIG. 2, the first, second and third lengths of material 30, 40 and 50 in the first preferred embodiment of the confetti tossing apparatus 1 respectively comprise members having a U-shaped cross section. The first and second lengths of material 30, 40 are attached to the billboard portions 10a and 20a of the end panels 10 and 20 in side-by-side relationship having an inner leg of the respective first and second lengths of material 30, 40 adjacently disposed, the U-shaped members being disposed having the legs thereof oriented downwardly. The third length of material 50 is attached to the respective end panels 10, 20 having the respective legs thereof upwardly disposed between the legs of the respective first length of material 30 and the second length of material 40.

Figure 4:
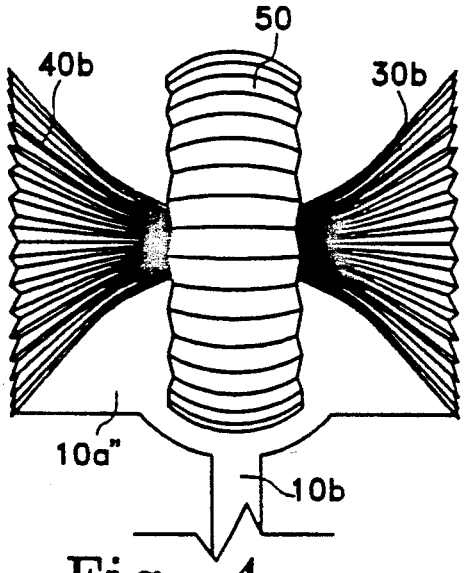
FIG. 4 is an end elevational view of the apparatus as shown in FIG. 3.
Figure 3:
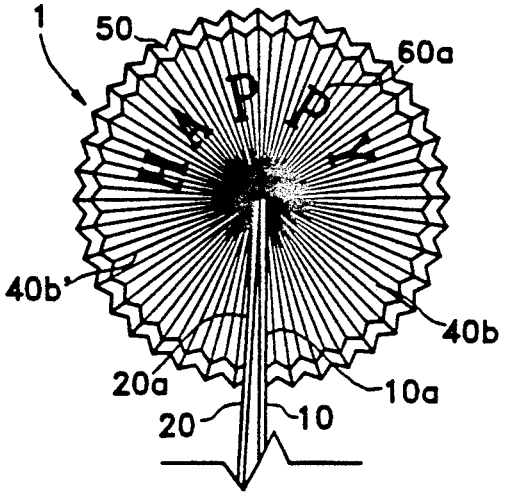
FIG. 3 is a side elevational view of the first apparatus disposed in the first open position.

The confetti tossing apparatus 1 is initially disposed having the respective first and second end panels 10, 20 in displaced relationship. In the present disclosure this disposition of the apparatus 1 is referred to as the closed position. A first open position of the confetti tossing apparatus 1 is obtained by rotating the second end panel 20 counterclockwise from the position illustrated in FIG. 1 to bring first end panel 10 and second end panel 20 in adjacent disposition as illustrated in FIG. 3. Thereby the first, second and third lengths of material 30, 40 and 50 are expanded about the respective end panels 10, 20. As can be seen in the side elevational view of the confetti tossing apparatus 1 illustrated in FIG. 4, when the apparatus 1 is disposed in the first open position the inner leg 30a, 40a of the respective first and second lengths of material 30, 40 is disposed beneath the third length of material 50 and the outer leg 30b, 40b of the respective first and second lengths of material 30, 40 is outwardly disposed. In the first preferred embodiment of the apparatus 1 a first part 60a of a celebratory greeting 60 (FIG. 3), for example the word "HAPPY", is displayed on the outside face 40b' of the outer leg 40b of the second length of material 40. The second part 60b of the celebratory greeting 60 is displayed when the apparatus 1 is unfolded to a second open position (FIG. 7) as hereinafter described. It should be understood that the first part 60a of the celebratory greeting 60 may be displayed on the first length of material 30 without departing from the spirit and scope of the present invention.

Figure 5:
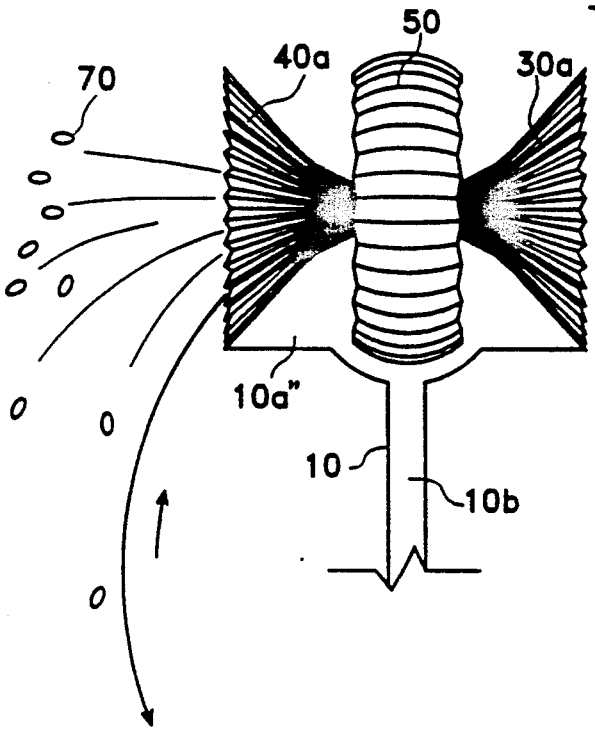
FIG. 5 is a partially fragmented end elevational view of the first apparatus disposed in the first open position.
Figure 5:
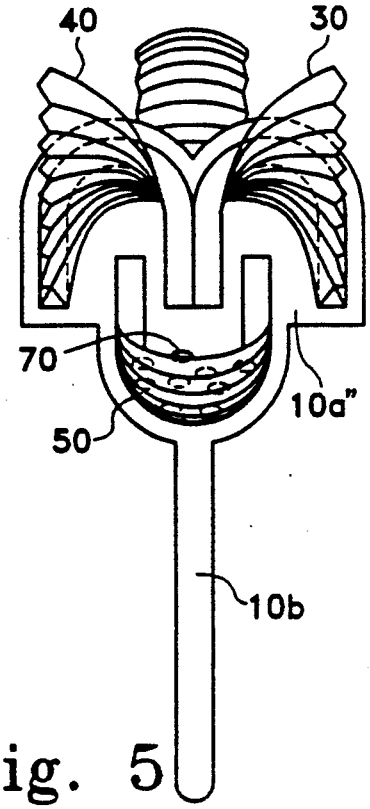

A further component of the confetti tossing apparatus 1 of the present invention is illustrated in FIG. 5—the confetti 70. Confetti 70 is disposed within and retained by the third length of material 50. When the apparatus 1 is unfolded to the second open position the confetti 70 is tossed outwardly from the apparatus 1.

Figure 6:
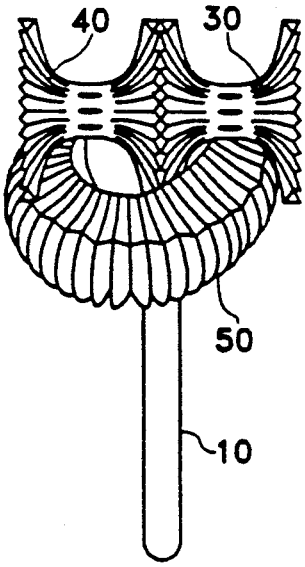
FIG. 6 is an illustration of the unfolding of the first apparatus from the first open position to the second open position.
Figure 7:
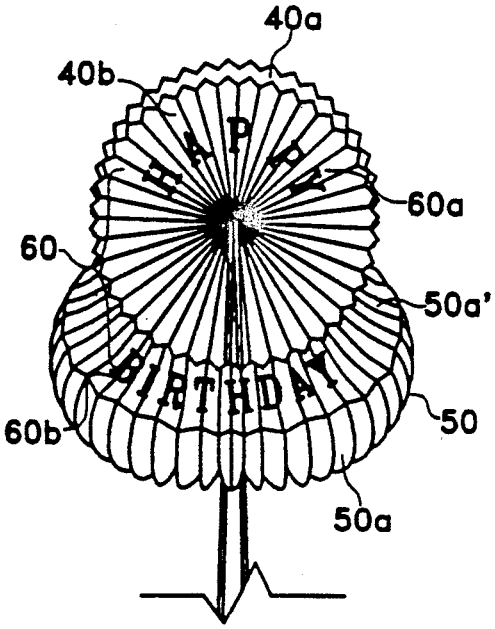
FIG. 7 is a side elevational view of the first apparatus disposed in the second open position.
Figure 8A:
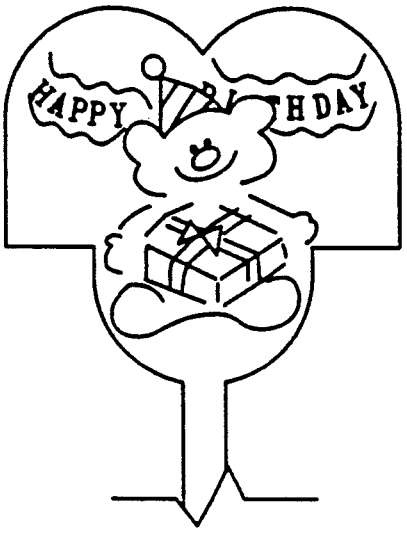
FIGS. 8A–8C are pictorial illustrations of the confetti tossing apparatus of the present invention showing respectively the closed position, the first open position and the second open position.
Figure 8B:
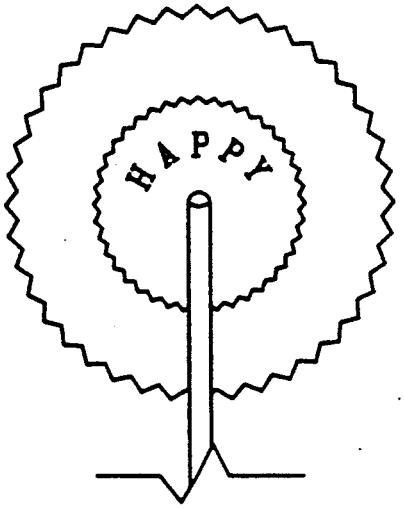
Figure 8C:
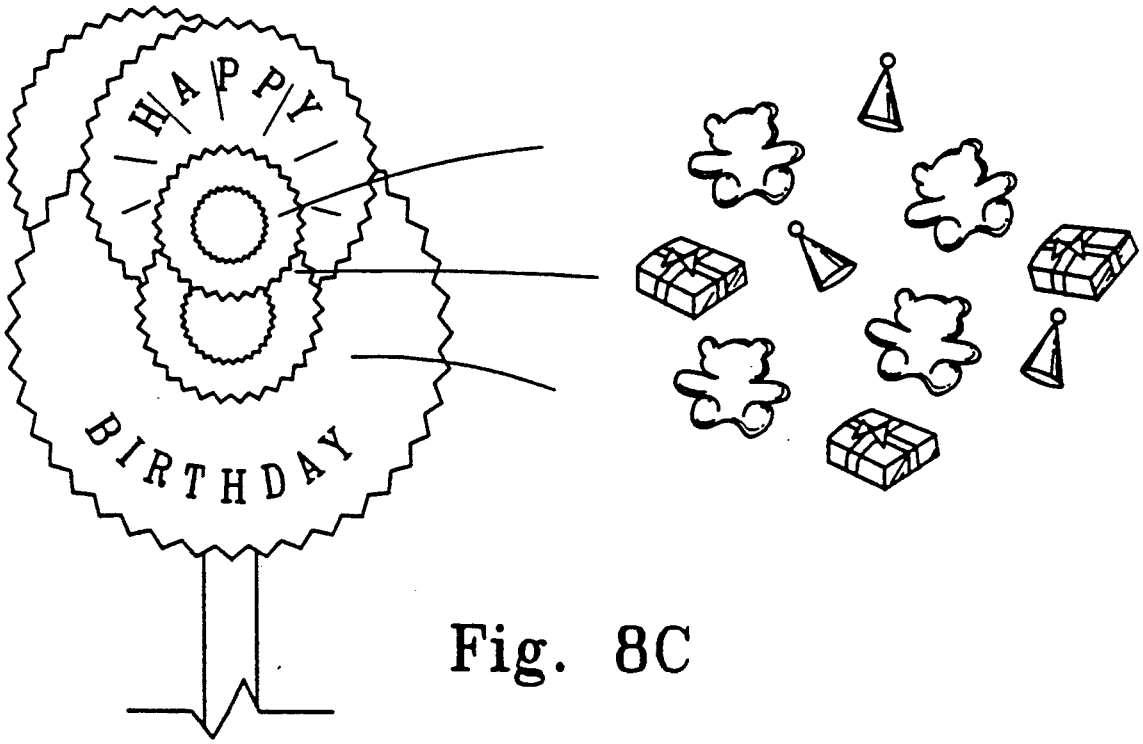
Figure 9A:
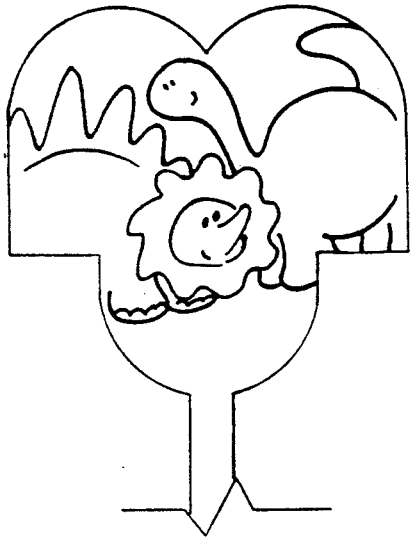
FIGS. 9A–9C are pictorial illustrations of the confetti tossing apparatus of the present invention showing respectively the closed position, the first open position and the second open position.
Figure 9B:
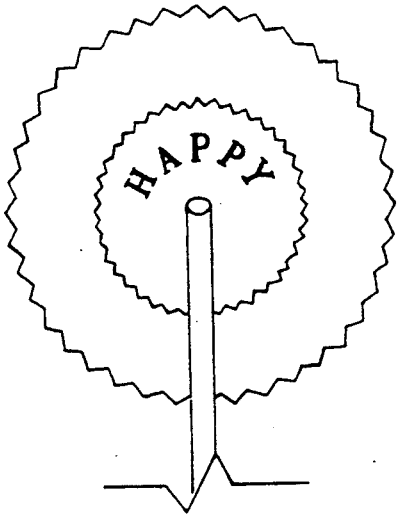
Figure 9C:
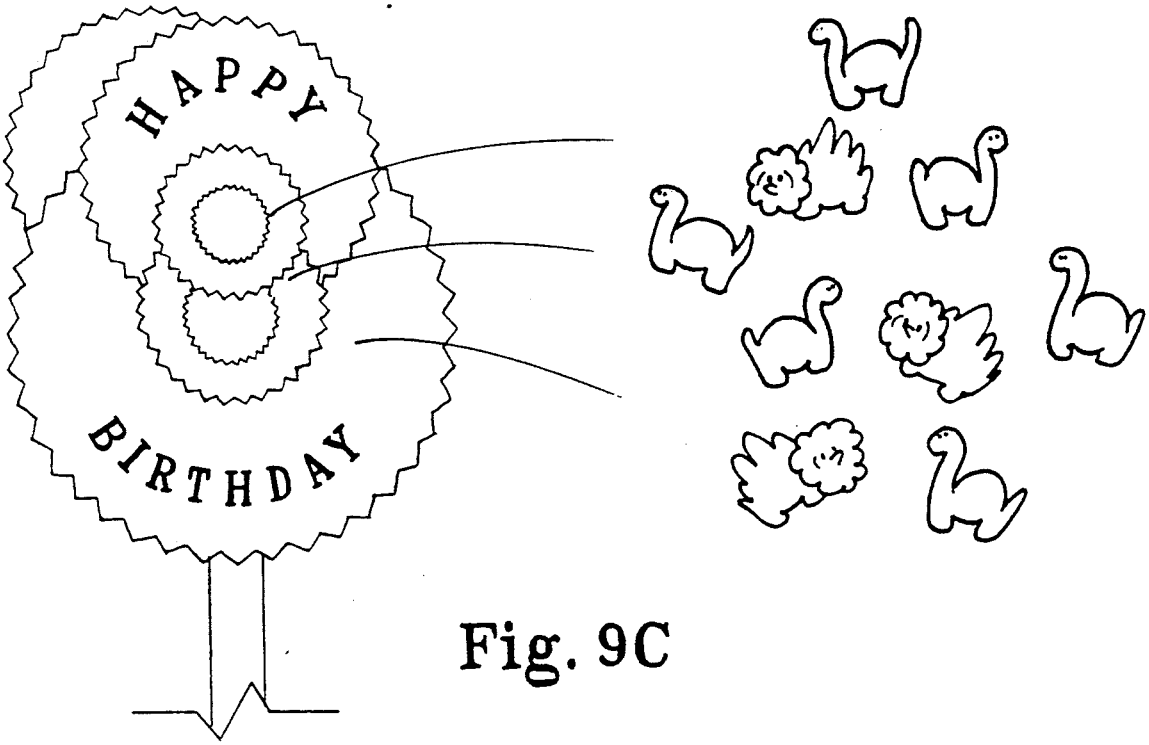
Figure 10A:
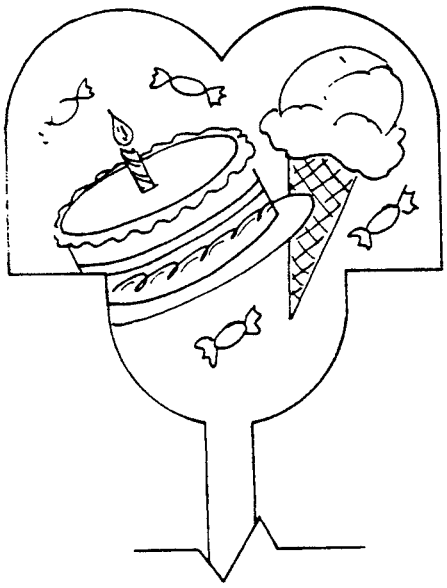
FIGS. 10A–10C are pictorial illustrations of the confetti tossing apparatus of the present invention showing respectively the closed position, the first open position and the second open position.
Figure 10B:
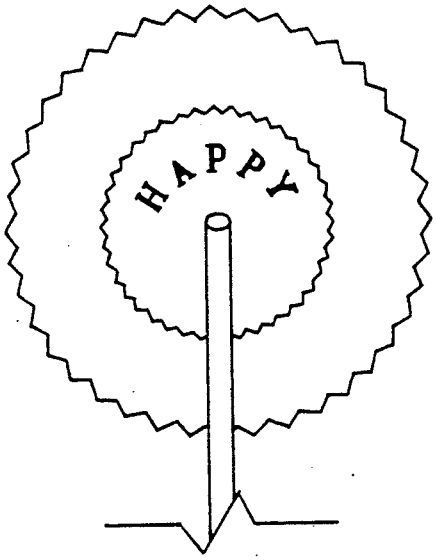
Figure 10C:
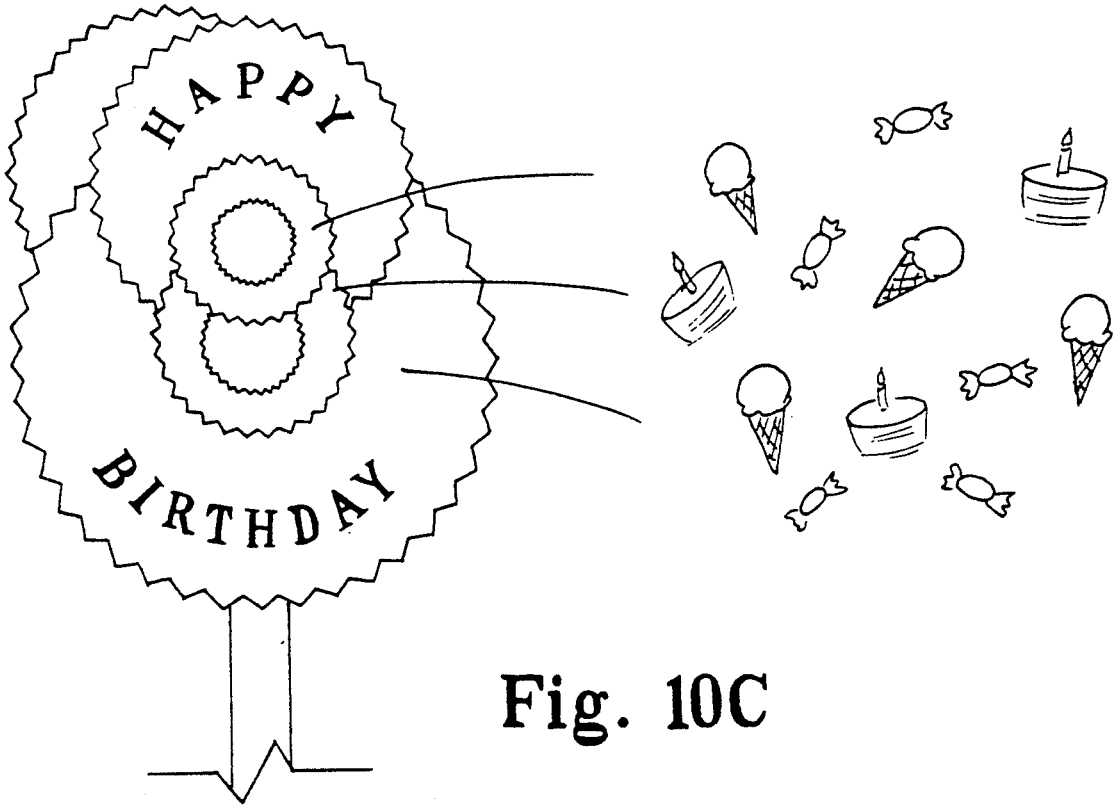
Figure 11A:
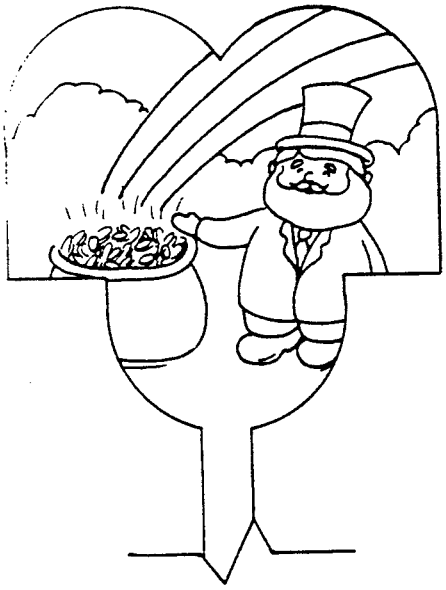
FIGS. 11A–11C are pictorial illustrations of the confetti tossing apparatus of the present invention showing respectively the closed position, the first open position and the second open position.
Figure 11B:
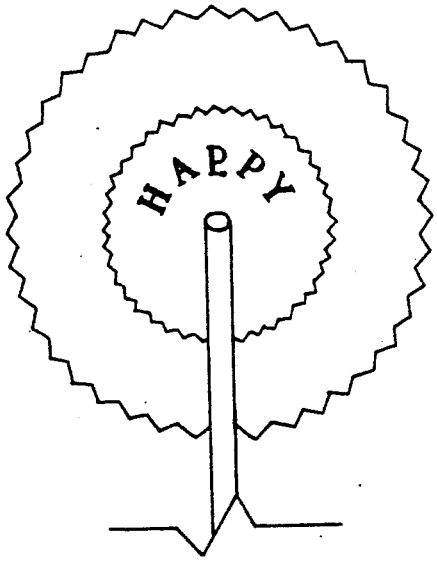
Figure 11C:
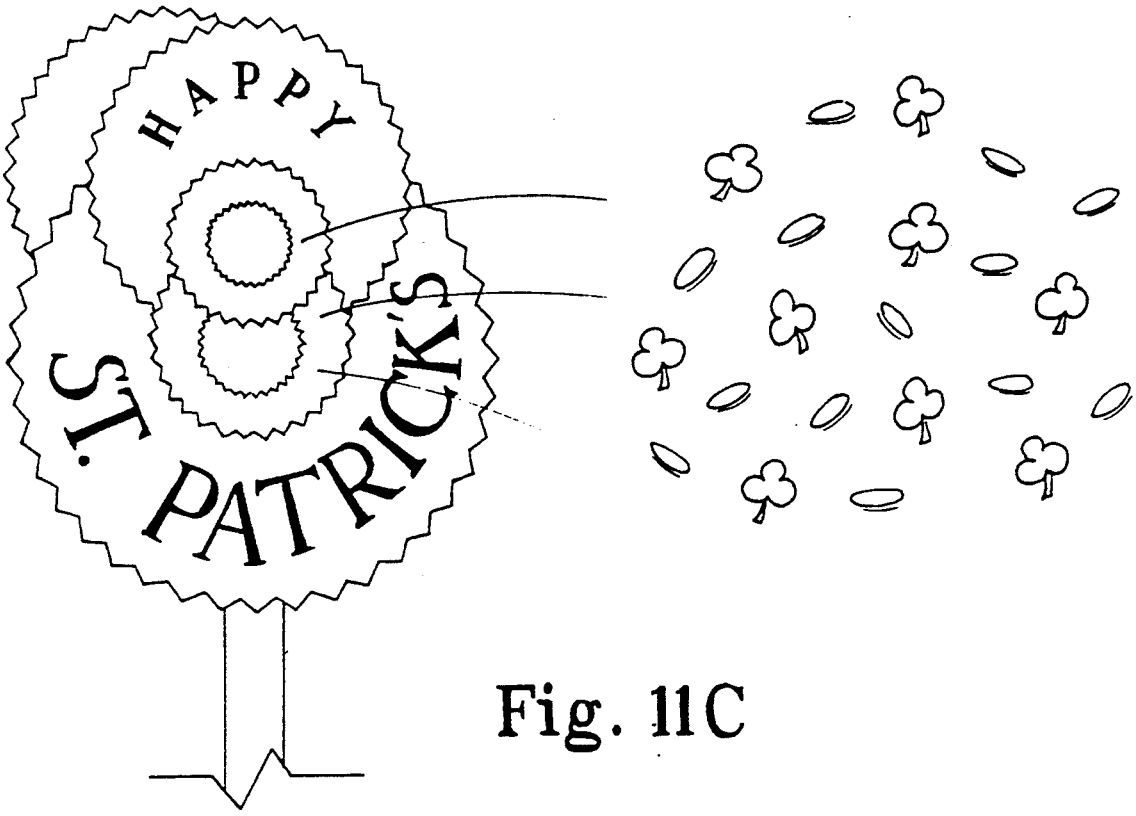
Figure 12A:
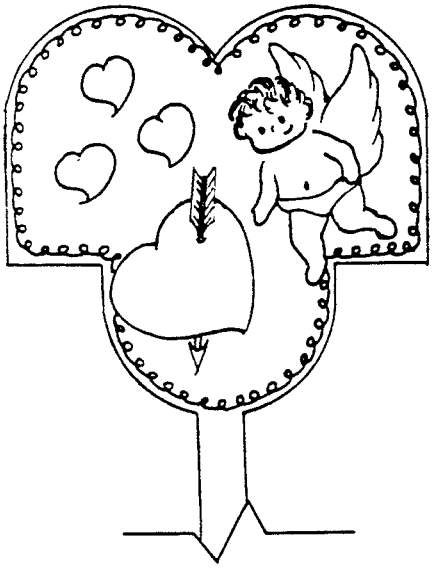
FIGS. 12A–12C are pictorial illustrations of the confetti tossing apparatus of the present invention showing respectively the closed position, the first open position and the second open position.
Figure 12B:
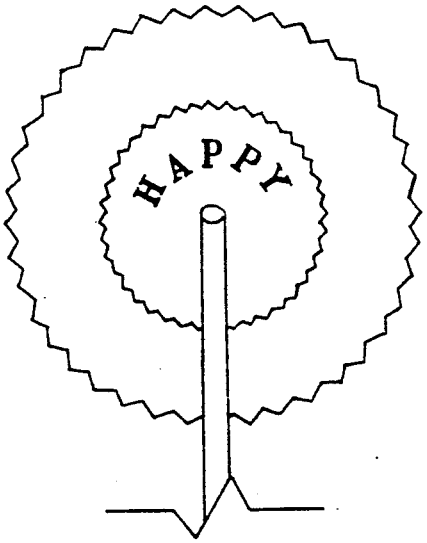
Figure 12C:
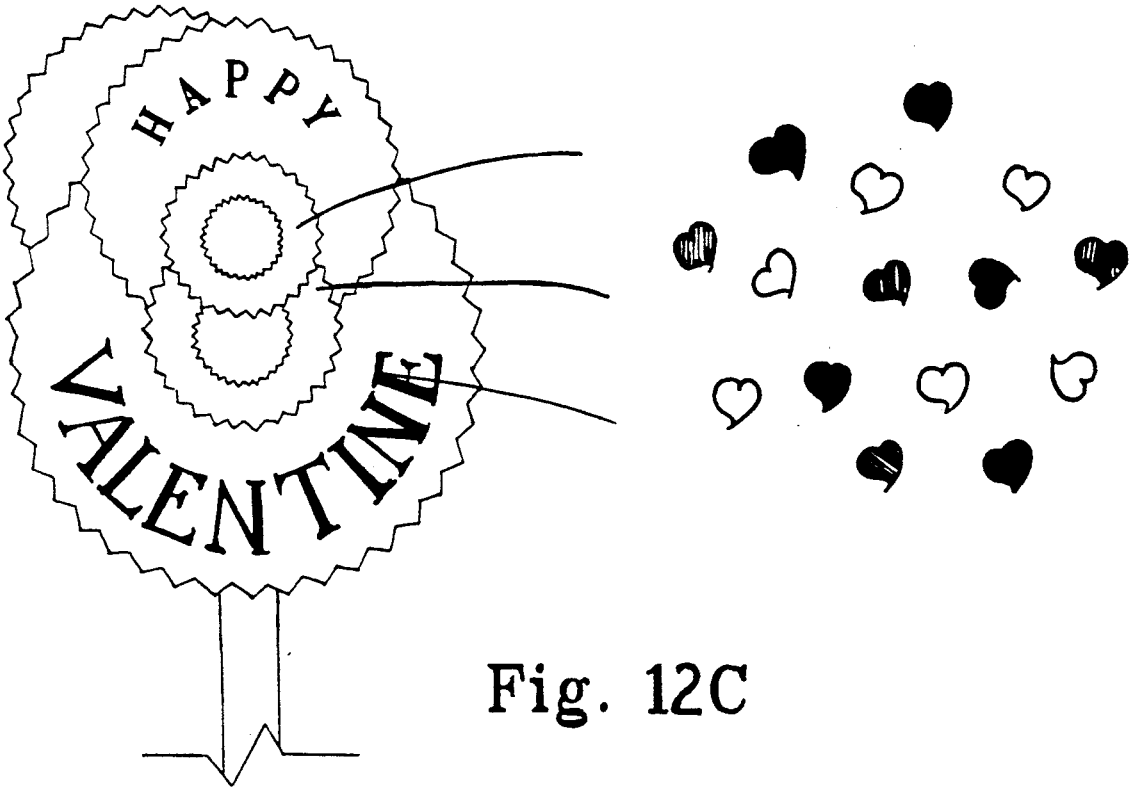
Figure 13A:
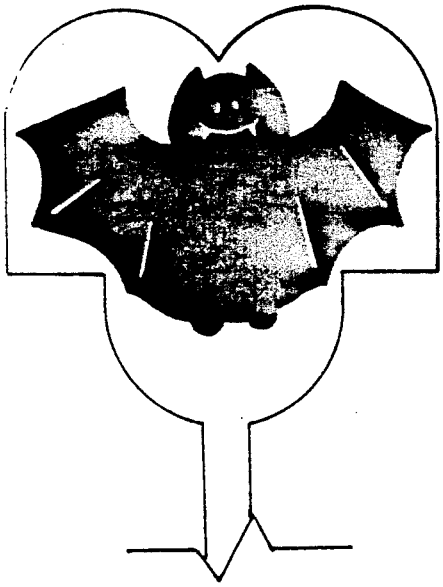
FIGS. 13A–13C are pictorial illustrations of the confetti tossing apparatus of the present invention showing respectively the closed position, the first open position and the second open position.
Figure 13B:
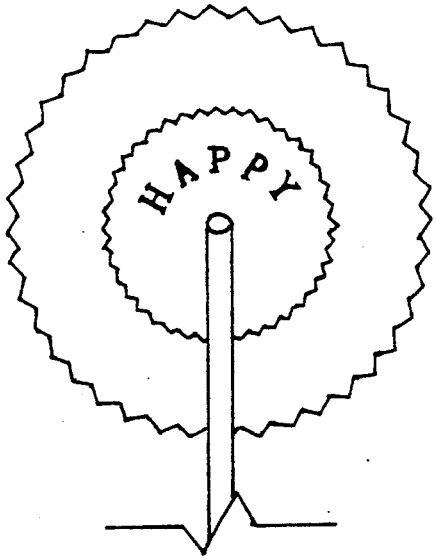
Figure 13C:
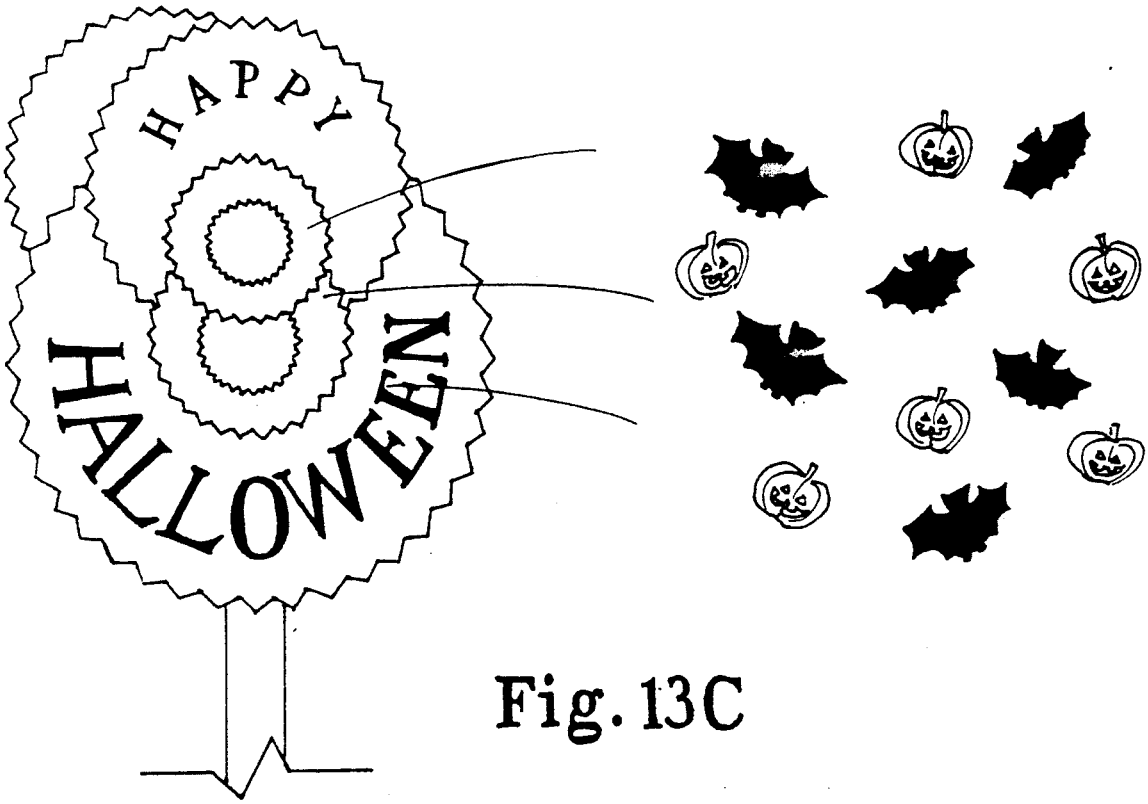
Figure 14A:
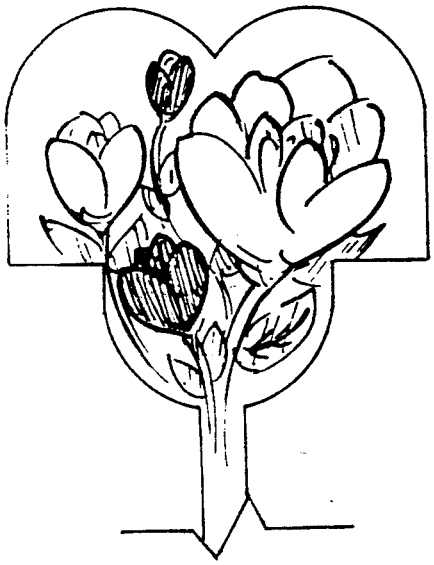
FIGS. 14A–14C are pictorial illustrations of the confetti tossing apparatus of the present invention showing respectively the closed position, the first open position and the second open position.
Figure 14B:
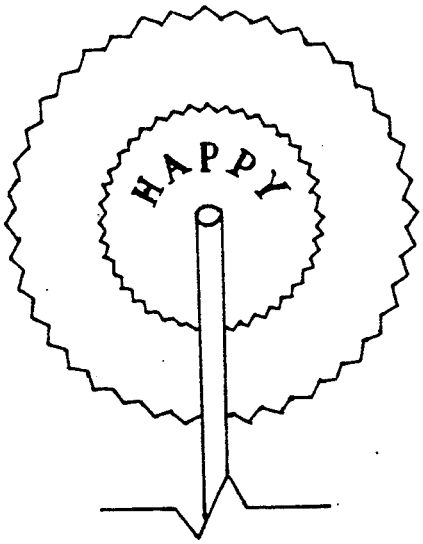
Figure 14C:
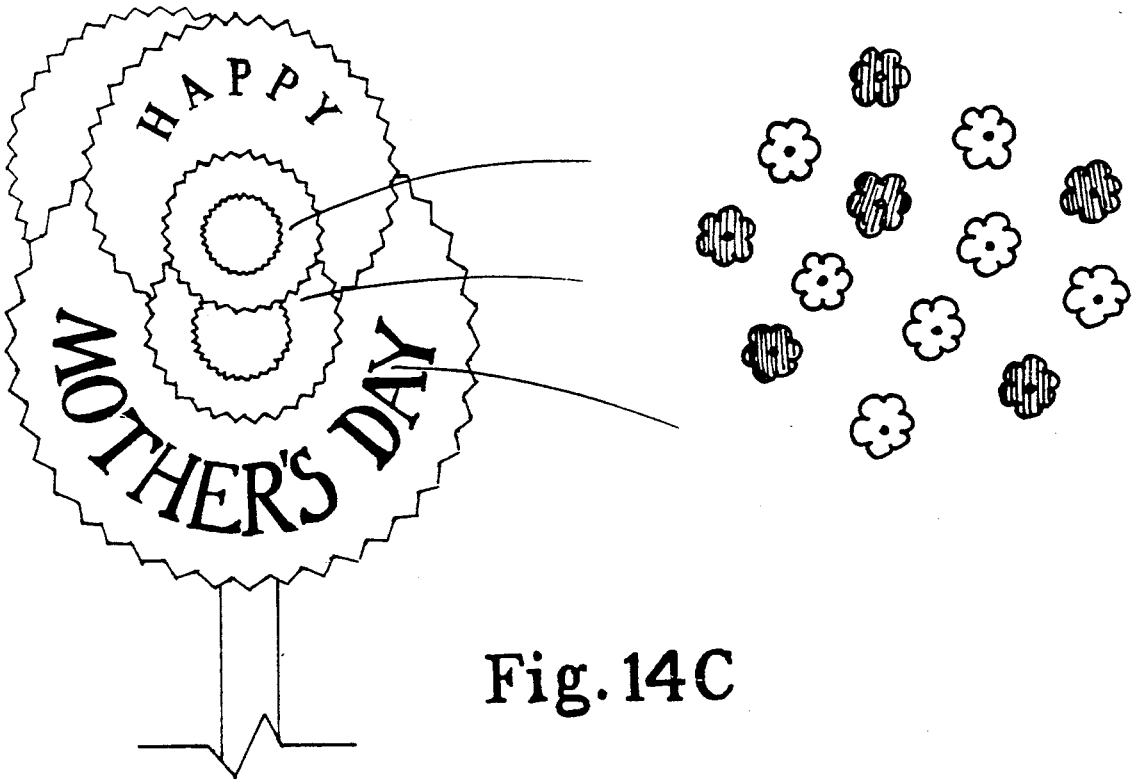

FIG. 6 illustrates the unfolding of the apparatus 1 from the first open position to the second open position. Apparatus 1 is held by the handle portion 10b, 20b of the end panels 10, 20 while disposed in the first open position, moved forward toward the second length of material 40 and jerked backwards. The third length of material 50 is thereby caused to move over the top of the second length of material 40 and lay disposed about the lower portion of the second length of material 40 and thereby toss the confetti 70 outwardly from the apparatus 1. As can be seen in FIG. 7 the second part 60b of the celebratory greeting 60, for example the word "BIRTHDAY", is displayed on the inside face 50a' of the rearward leg 50a (as measured from the direction of the forward motion of the apparatus 1 prior to jerking) of the third length of material 50. Thus, when the apparatus 1 is disposed in the second open position, the entire celebratory greeting 60 can be seen.

The confetti tossing apparatus 1 of the present invention provides a novel and unique means for expressing a celebratory greeting 60. As should be readily understood by those skilled in the art various celebratory greetings may be displayed on the apparatus 1 as heretofore described. Furthermore, a plurality of lengths of material in excess of three as shown in the first preferred embodiment of the apparatus 1 illustrated in FIGS. 1–7 may be attached to the respective first and second end panels 10 and 20 to form a variety of first open positions and second open positions, even ornamental shapes (similarly to balloon sculpture). FIGS. 8–14 pictorially depict the variety of celebratory greetings that may be expressed by use of the present invention and further illustrates additional novel features of the confetti tossing apparatus 1. In FIGS. 8–14 "FIG. A" illustrates an elevational view of an end panel, "FIG. B" illustrates a first open position, and "FIG. C" illustrates a second open position of the confetti tossing apparatus 1. In these further exemplary embodiments of the present invention an ornamental design 80 is displayed on the billboard portion 10a of a first end panel 10, preferably suggestive of the celebratory greeting 60, and shaped confetti 70' is formed in ornamental shapes corresponding to the ornamental design 80 on the end panel 10. As should be understood the variety of ornamental designs 80 and corresponding shaped confetti 70' that may be employed in confetti tossing device 1 of the present invention is virtually endless.

Figure 15:
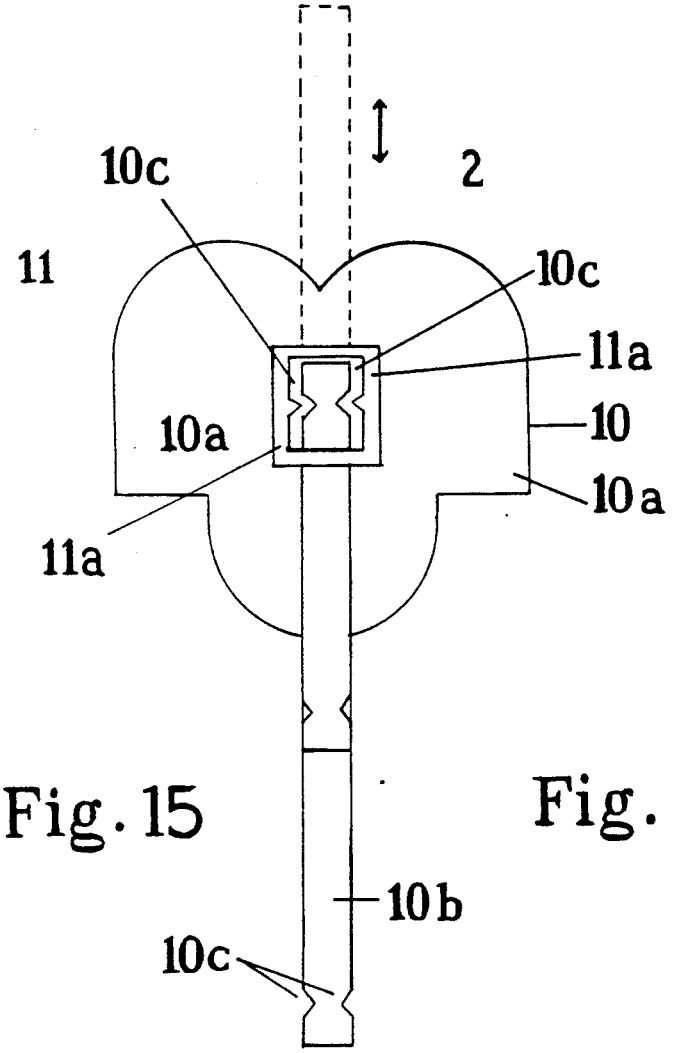
FIG. 15 is an end elevational view of a second embodiment of the confetti tossing apparatus of the present invention.
Figure 16:
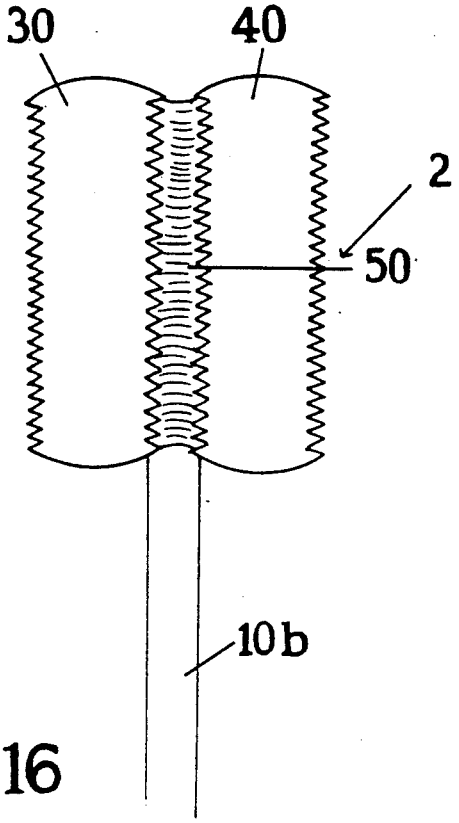
FIG. 16 is a side elevational view of the second apparatus disposed in the first open position.

The configurations achievable by the lengths of material 30, 40 and 50 in the respective first open position and second open position can be expanded by use of adjustable end panels. FIG. 15 illustrates a preferred embodiment of an adjustable first end panel 10' for a second confetti tossing apparatus 2 which is typical of the second end panel 20'. Adjustable first end panel 10' comprises a billboard portion 10a having a handle clip 11' fixedly disposed on the forward face 10a' of the billboard portion 10a and a sliding handle portion 10b' which engages the clip 11'. Clip 11' is formed having engagement slots 10c at each end thereof which cooperably engage the engagement pins 11a' of clip 11'. Thus, sliding handle portion 10b' can be disposed for a closed position as previously described for the first preferred embodiment of the apparatus 1 and as shown by the solid lines in FIG. 15 or alternatively slid and engaged at the opposite end thereof for an alternative closed position to provide a first open position as illustrated in FIG. 16. The second apparatus 2 is operable in the same manner as previously described from either of the alternative closed positions.

Figure 17:
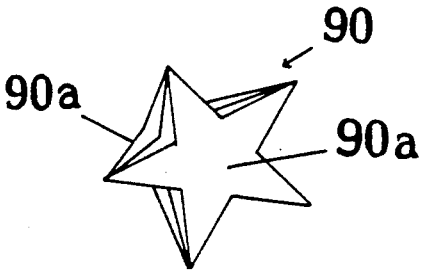
FIG. 17 is a perspective view of three-dimensional confetti suitable for use in the apparatus of the present invention.

Confetti is generally formed as a two-dimensional member and this construction contributes greatly to the generally known cleanup problems. FIG. 17 illustrates an improved three-dimensional confetti 90 suitable for use in the confetti tossing apparatus 1 or 2 of the present invention. Three-dimensional confetti 90 may be formed in a variety of ways, including molded and crumpled shapes. The preferred three-dimensional confetti 90 illustrated in FIG. 17 comprises two curved members 90*a* of identical construction disposed and fixedly attached back-to-back by glue, for example. Of course, three-dimensional confetti 90 formed by an extrusion or similar process is equally suitable for use in the apparatuses 1 or 2 of the present invention.

Various changes and modifications may be made to the present invention without departing from the spirit and scope of this disclosure. Such changes and modifications within a fair reading of the following claims are intended as part of the present invention.

Therefore, in the view of the foregoing, I claim:

1. A confetti tossing apparatus comprising a first end panel;

a second end panel;

first, second and third unitary lengths of laterally-curved paper material fixedly attached at respective ends thereof to said first end panel and said second end panel, said respective lengths of paper material being folded in accordion fashion along their respective lengths between the respective end panels, said first, second and third lengths of paper material respectively comprising a member having a U-shaped cross-section, the first and second lengths of paper material each having an inner leg thereof adjacently and downwardly disposed in a lateral side-by-side relationship and the third length of paper material being disposed having the respective legs thereof disposed upwardly between an inner leg and an outer leg of the respective first and second lengths of paper material, said third length of paper material forming a pocket for receipt of a body of confetti, said confetti being selectively releasable from said tossing apparatus by manipulation of said lengths of paper material from a first open position to a second open position; and a body of confetti selectively receivable within the pocket formed by said third length of paper material.

2. A confetti tossing apparatus as in claim 1 wherein a first part of a celebratory greeting is outwardly displayed on an outside face of the outer leg of the second length of paper material when said apparatus is disposed in said first open position and a second part of the celebratory greeting is outwardly displayed on an inside face of a leg of said third length of paper material when said apparatus is disposed in said second open position.

3. A confetti tossing as in claim 1 wherein said body of confetti comprises a plurality of three-dimensional shapes.

4. A confetti tossing apparatus comprising:

a first end panel having a first billboard portion formed with an inside surface and an outside surface, and a first handle portion extending from said first billboard portion;

a second end panel having a second billboard portion formed with an inside surface and an outside surface, and a second handle portion extending from said second billboard portion;

a first unitary length of material folded in accordion fashion and having a U-shaped lateral cross-section;

a second unitary length of material folded in accordion fashion and having a U-shaped lateral cross-section, said first length of material and said second length of material being disposed in side-by-side relationship having an inner leg of the respective first and second lengths of material adjacently and downwardly disposed, said first length of material and said second length of material being fixedly attached at respective ends thereof to an upper portion of the inside surface of the respective billboard portions of the first end panel and the second end panel; and a third unitary length of material folded in accordion fashion and having a U-shaped lateral cross-section, said third length of material having the legs thereof upwardly disposed, each leg thereof being disposed between the inner leg and an outer leg of the respective first length of material and second length of material, said third length of material being fixedly attached at respective ends thereof to a lower portion of the inside surface of the respective billboard portions of the first end panel and the second end panel, said third length of material forming a pocket for receipt of a body of confetti selectively releasable from said tossing apparatus.

said respective first, second and third lengths of material having indicia of a celebratory greeting disposed on respective surfaces thereof, said indicia being alternately presented outwardly by manipulation of said tossing apparatus.

5. A confetti tossing apparatus as in claim 4 further including a body of confetti disposed within the pocket formed by said third length of material.

6. A confetti tossing apparatus as in claim 5 wherein a first part of the greeting is displayed on said first length of material when said apparatus is disposed in a first open position and a second part of the celebratory greeting is displayed on said third length of material in conjunction with the first part of the celebratory greeting when said apparatus is disposed in a second open position.

7. A confetti tossing apparatus as in claim 5 wherein a first part of the celebratory greeting is displayed on said second length of material when said apparatus is disposed in a first open position and a second part of the celebratory greeting is displayed on said third length of material in conjunction with the first part of the celebratory greeting when said apparatus is disposed in a second open position.

8. A confetti tossing apparatus as in claim 5 further including an ornamental design on the outside surfaces of the billboard portions of the respective first and second end panels.

9. A confetti tossing apparatus as in claim 8 wherein the body of confetti comprises a plurality of ornamental shapes coordinated with the ornamental design on said first and second end panels.

10. A confetti tossing apparatus as in claim 9 wherein said ornamental shapes are three-dimensional shapes.

11. A confetti tossing apparatus as in claim 10 wherein the first and second handle portions of the respective first and second end panels is adjustable.

12. A confetti tossing apparatus as in claim 11 wherein the respective billboard portions of the respective end panels includes a clip having an engagement pin and the respective handle portions includes an engagement slot at respective ends of said handle portions, said engagement pin and said engagement slot being mutually cooperable and said respective handle portions being slidably movable relative to said clips.

* * * * *